United States Patent [19]

Speer et al.

[11] 4,424,781

[45] Jan. 10, 1984

[54] MODIFIED CONTROL LINKAGE FOR SUPERCHARGED INLET AIR TO INTERNAL COMBUSTION ENGINE

[76] Inventors: Stephen R. Speer, S. 358 Cover d'Alene Apt. #6; Hugh G. Evans, W. 214 6th Ave., both of Spokane, Wash. 99204

[21] Appl. No.: 400,899

[22] Filed: Jul. 22, 1982

[51] Int. Cl.[3] ..... F02D 9/08

[52] U.S. Cl. ..... 123/342; 74/98; 123/403; 60/600

[58] Field of Search ..... 74/98; 123/342, 319, 123/403, 402; 60/600, 601

[56] References Cited

U.S. PATENT DOCUMENTS

| | | | |
|---|---|---|---|
| 1,983,225 | 12/1934 | Gregg | 123/564 |
| 2,255,753 | 9/1941 | Bates | 123/403 |
| 2,500,234 | 3/1950 | Bates | 60/600 |
| 2,506,248 | 5/1950 | Szydlowski | 123/564 |
| 2,612,058 | 9/1952 | Waite | 74/98 |
| 3,039,027 | 6/1962 | Cuches | 74/98 |
| 4,337,743 | 7/1982 | Mattson | 123/342 |

*Primary Examiner*—William A. Cuchlinski, Jr.
*Attorney, Agent, or Firm*—Barry G. Magidoff

[57] ABSTRACT

A control linkage is provided between an actuating crank and the throttle butterfly valve of an internal combustion engine. The control linkage is a second degree hesitation mechanism, such as an epicyclic gear train, for example having a gear ratio of 4:1 and an eccentricity ratio of between 0.7 and 0.8. The control linkage results in a more linear relationship between engine output and the rotational movement of the actuating crank.

16 Claims, 17 Drawing Figures

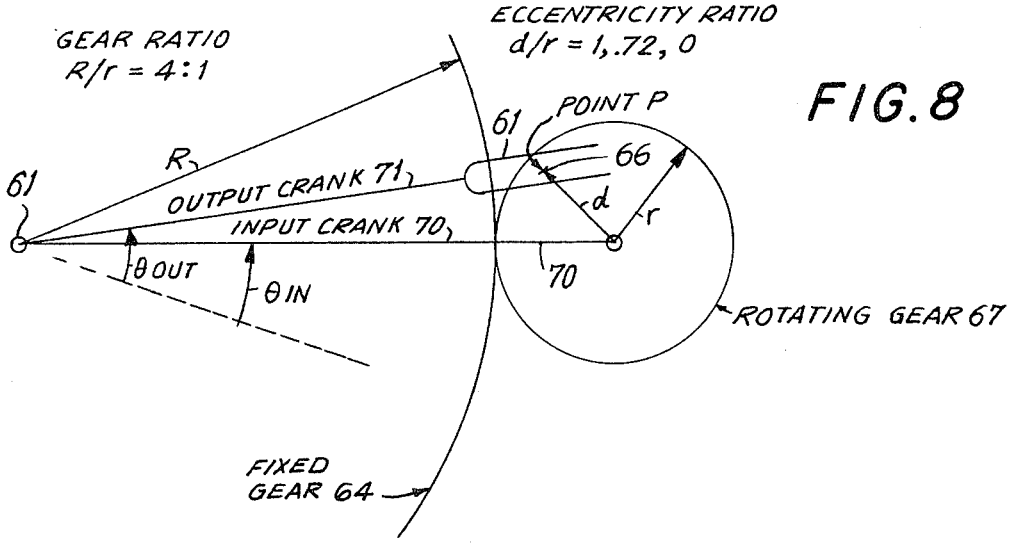
FIG. 8
FIG. 9a
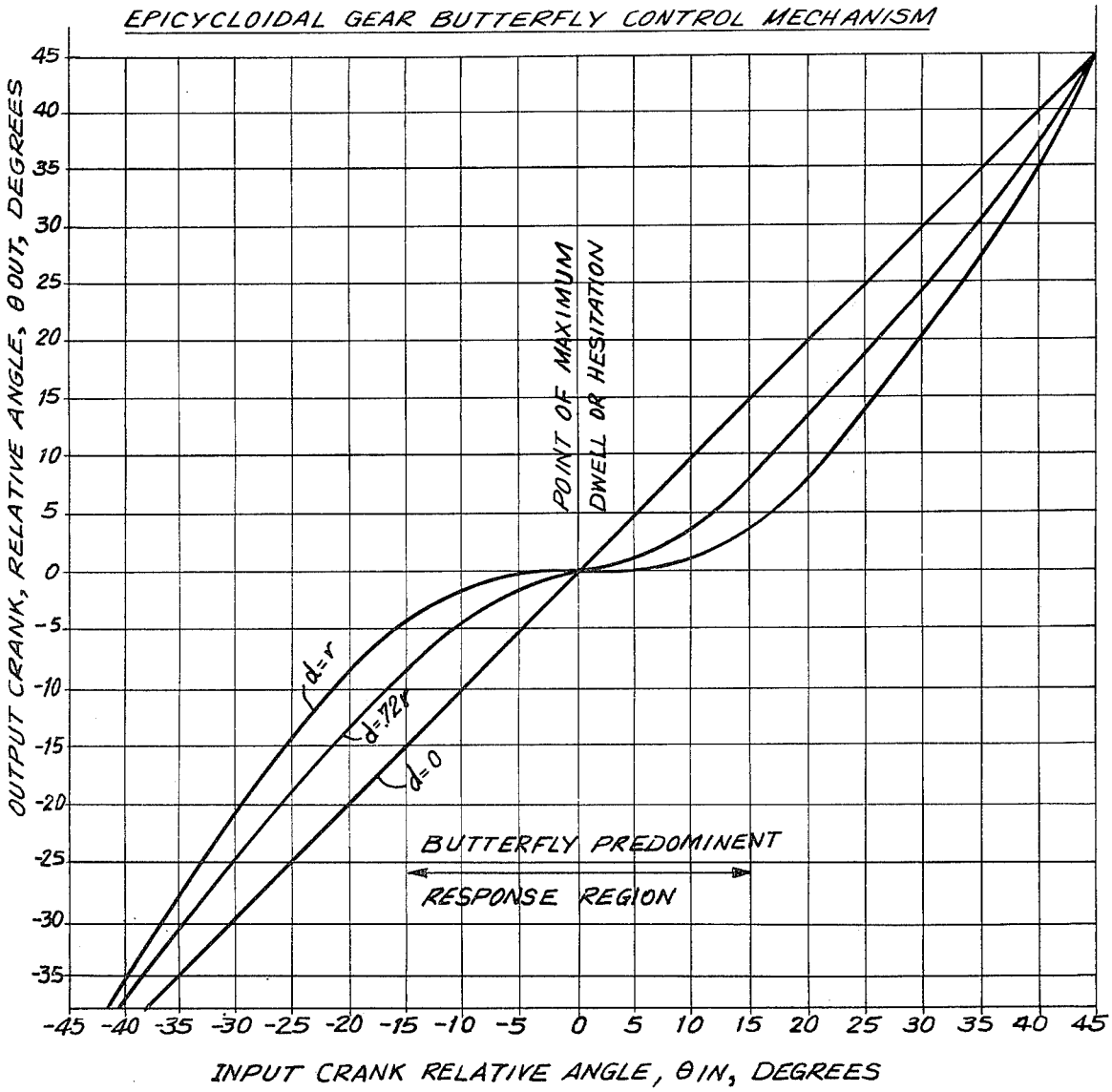

FIG. 9c
RELATION BETWEEN BUTTERFLY AND DWELL MECHANISM ANGULAR MOVEMENT AND ENGINE RESPONSE
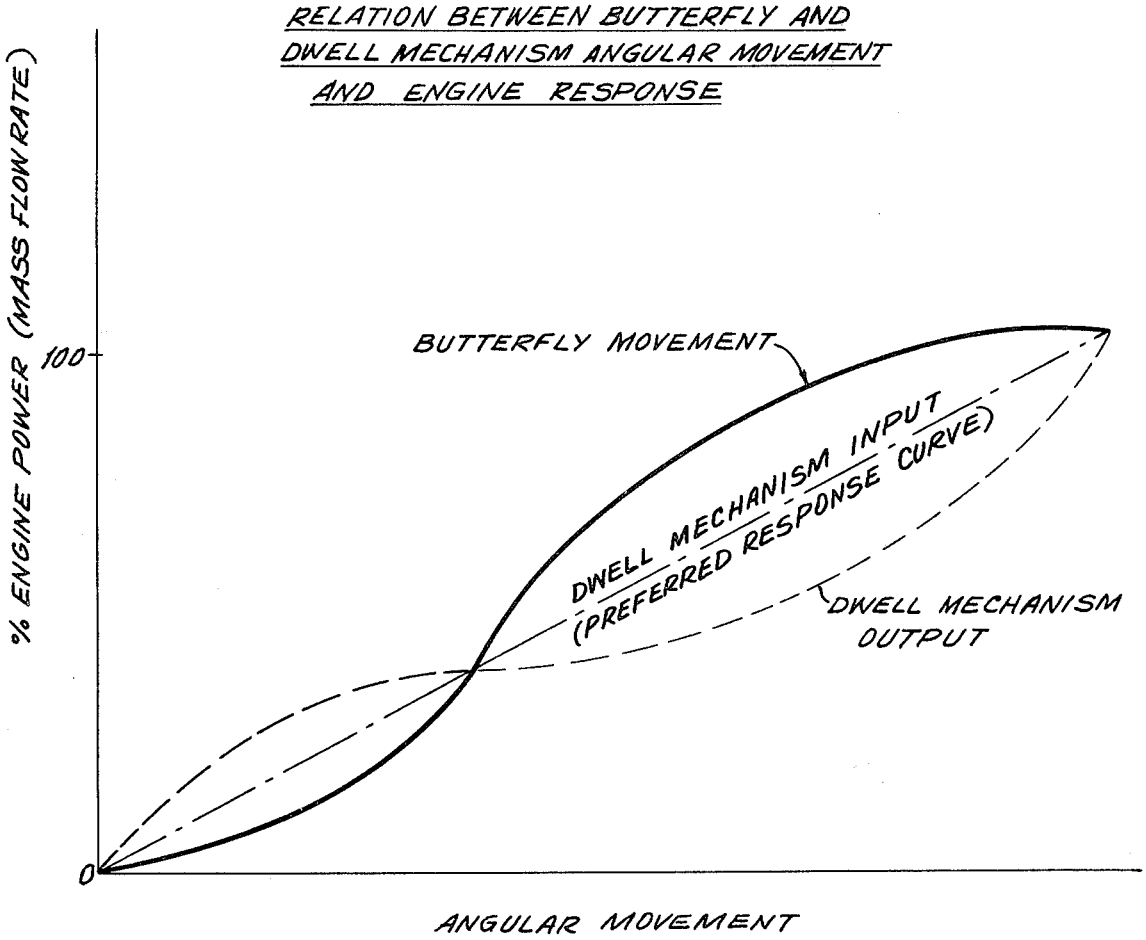
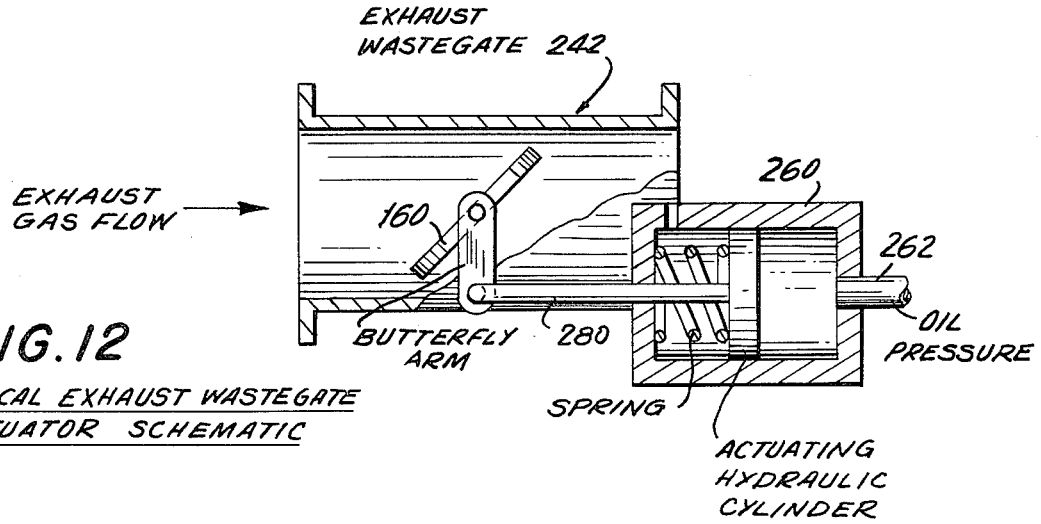
FIG. 12
TYPICAL EXHAUST WASTEGATE ACTUATOR SCHEMATIC

GENERAL 4-BAR LINKAGE MECHANISM

GENERAL 6 BAR LINKAGE MECHANISM

6-BAR CONTROL MECHANISM

HYPOCYCLOIDAL MECHANISM

CYCLOIDAL MECHANISM

MODIFIED CONTROL LINKAGE FOR SUPERCHARGED INLET AIR TO INTERNAL COMBUSTION ENGINE

This invention provides a suitable linkage mechanism for obtaining desirably sensitive control over a rotating, or butterfly-type, valve, for example, of the type generally used in the throttle control for an internal combustion engine. More particularly, this invention provides means to mechanically improve the control sensitivity over a butterfly-type throttling valve.

Modern high performance engines, espcecially those used for aircraft, require relatively high mass flow rates of inlet air, which are generally pressurized. Such "supercharged", high mass flow rates are generally achieved by compressing the air, through any of several available types of compressors or superchargers, and then controlling the flow of such compressed air passed to the engine by a butterfly valve with a relatively large throat.

The butterfly valve, as is well known, operates by rotation of the valve member, or butterfly, within the throat of the valve, between a closed position, the butterfly being generally perpendicular (approximately 80°-90° ) to the flow, or longitudinal, axis of the valve throat, and a fully opened position, the butterfly valve being almost parallel to the flow axis (generally at an angle of about 5°-10° from the axis of the throat). As the butterfly valve member rotates, the cross-sectional area of the throat open to flow is varied from substantially zero to maximum.

Unfortunately the flow rate through the valve does not change linearly with angular rotation of the butterfly, i.e., a given angle of rotation of the butterfly does not result in an equal proportional incremental change in the mass flow rate over the entire range of rotational movement of the butterfly. Generally, at the initial opening, or cracking, of the valve, the incremental change in mass flow of fluid is relatively smaller, proportionally, than the incremental angular movement of the valve member. For the conventional butterfly valve, the incremental change in mass flow per given angular change in the valve member increases sharply during a mid-range portion of the butterfly's total rotation, i.e., generally during at least a portion of the range of between 30° and 60° of the flow axis. As the butterfly is further rotated beyond the mid-range towards being fully open, the incremental change in mass flow per angular rotation again decreases sharply, until there is an almost negligible change in mass flow when the butterfly is rotated to within 10° of the axis. The causes of this non-linear change in the effect of the valve in varying fluid flow is a combination of the geometry of the valve and the flow characteristics of most gases.

This variable, non-linear flow-controlling effectiveness of the butterfly valve necessarily finds its counterpart in the response of an internal combustion engine that uses a butterfly valve as its throttle control. Beginning from idle, the power output of the engine at first increases relatively gradually as the butterfly is rotated away from the closed position (e.g. from an angle of 85° from the flow axis), which is evidenced by a hesitation in the engine output. As the butterfly is further rotated past an angle of about 60° to the flow axis, the change in engine power output increases far more rapidly per incremental rotation of the butterfly, which is evidenced by surging of the engine, until the butterfly approaches an angle of about 30° from the flow axis. From this point the change in engine power output per incremental rotation sharply drops, until it becomes almost "flat", when the butterfly extends to within about 10° of the flow axis, an area sometimes referred to as "dead center" positions. A graphic representation of this variable engine output response curve of the butterfly valve is shown by the dotted curve in FIG. 9(*c*).

The problem of variable engine response to an incremental opening of a butterfly throttle valve has not previously been satisfactorily resolved. The recent introduction of high performance, supercharged, internal combustion engines for use in general aviation has highlighted this problem. In such cases, where the butterfly throat is relatively large, and the inlet air is compressed to substantially above ambient pressures, the extreme sensitivity of the butterfly-type throttle in the mid-range has made accurate throttle control difficult. The problem can, of course, be easily controlled by the use of an electronic system, where the movement of the valve member is electronically proportioned by any of a number of complex electronic, generally solid state, systems. Such systems can be provided by the use of so-called "microchips". However, such devices are rather complex, and not readily serviced by the average civilian aviation mechanic.

It is therefore an object of the present invention to provide mechanical linkage between the pilot control means and the engine throttle for providing the desired precision of control over the full range of operation. A further object of this invention is to provide such control when operating a high performance aircraft engine.

Yet a further object of this invention is to provide more precise control over the most sensitive portion of the operating range of an engine throttle valve and to reduce the "dwell", or hesitation, during the less sensitive portions of the operating range of the throttle valve.

In accordance with the present invention, variable rate control linkage means are provided for mechanically connecting a throttle control member to the butterfly-type throttle valve for an internal combustion engine, the linkage means providing cyclically variable output movement advantage between the control member and the butterfly-type valve over the operating range of the butterfly-type valve. Such output movement advantage, or ratio, between the angle of rotation of the control member and of the butterfly-type valve should be less than one during the two end periods of rotation and greater than one during the mid-range of rotation of the butterfly valve.

In the mechanical art of kinematics, mechanical transmission means, for example, for driving knitting needles in automatic knitting mills, have long been used to provide a desirable variable rate continuous movement, where the acceleration and velocity of the, e.g., knitting needle, varies periodically during each cycle of movement. For example, the needle swiftly accelerates, then slows down, reverses direction, slowly accelerates, quickly accelerates, slowly decelerates, reverses direction, etc. Such a device is characterized by the term "dwell" mechanism, or more specifically, "second or higher degree hesitation" mechanism.

In accordance with this invention, a second degree or higher hesitation-generating mechanical linkage is provided between the control drive means, or input, and the butterfly-type valve member, or output, that counterbalances the inherent hesitation effect on engine response of the butterfly-type throttle valve. Degrees of hesitation of a value greater than two, should be whole, even numbers, in order to insure that the output motion remains in the same direction as the input motion. Such hesitation mechanisms that can be customized to provide an output having initial acceleration, followed by a mid-range deceleration, and a final acceleration, without change of direction, during a total approximately 90° range of rotational movement, are known generally as 4-bar linkages. More complex, but effective, systems within this type are known as 6-bar linkages. The term "linkage" denotes a general concept including, for example, rods, cranks, gears, rollers, pins, or sliders, used to transmit motion. A mechanical linkage system including a slotted output crank driven by a pin traversing a path has been referred to as a "point path mechanism", *JOURNAL OF ENGINEERING FOR INDUSTRY*, "HESITATION", by B. L. Harding, "Transactions of the ASME", May, 1965, pp. 205–211.

The 6-bar linkage is a type of 4-bar linkage and can be visualized as two overlapping 4-bar linkages, the input to the second 4-bar linkage being taken from a point along one side of the first 4-bar linkage. A schematic diagram of each of the 4-bar and 6-bar mechanisms is shown in FIGS. 10(*a*) and (*b*). The desired output motion is obtained by selecting the proper location of the input to the second 4-bar linkage. A connecting linkage is shown in FIG. 10(*c*).

Surprisingly, these variable acceleration transmission mechanisms can be utilized in the present invention to provide the desired variable output movement advantage between the control member and the butterfly-type valve. A 4-bar type linkage is interconnected between the control member and the valve such that a substantially straight line relationship can be optimally achieved between incremental movement of the control member and incremental change in the power output of the engine.

The 6-bar linkage provides a more desirable degree of flexibility, or range of output, than a simple 4-bar linkage. Indeed, a simple 4-bar linkage is of very limited utility for a butterfly valve where the total range of rotation should be not more than 90°, and when it is preferred that the control member rotate the same total number of degrees as the valve member. One of the more preferred examples of a 6-bar mechanism is an epicycloidal gear train, a type of point-path mechanism (shown in FIG. 8). As the input crank is rotated to move the butterfly valve over a 90° range, the output crank first jumps ahead, then lags, then accelerates to catch up to the input crank.

More specifically, this invention comprises an internal combustion engine, an air inlet throat to the engine, a rotating valve member in the throat for controlling air flow to the engine as a means of controlling engine power output, a manual control means for opening and closing, by rotating, the valve member, and a hesitation mechanism connected between the manual control means and the rotating valve so designed that the incremental change in engine output with incremental angular movement of the throttle valve control means is more nearly a straight line.

In the accompanying drawings, an example of an advantageous embodiment of the apparatus in accordance with the present invention is set forth. The apparatus is for the most part shown and described in schematic terms, often in essentially symbolic manner, because of the conventional nature of the individual portions of the apparatus. Appropriate structural details for actual operation, where not explicitly set forth, are generally known and understood and need not be set forth in greater detail herein, as they are not part of the present invention. Elimination of such unnecessary disclosure of conventional apparatus, permits greater emphasis and clarification of the scope and concept of the present invention. Conventionally available elements in the system are described generically and by a reference to a specific example, where possible, including a trade designation for a presently available device from a well known United States manufacturer.

In the drawings:

FIG. 8 is a line diagram of a variable movement advantage control linkage of this invention utilizing an epicycloidal gear train;

Figure 9B:
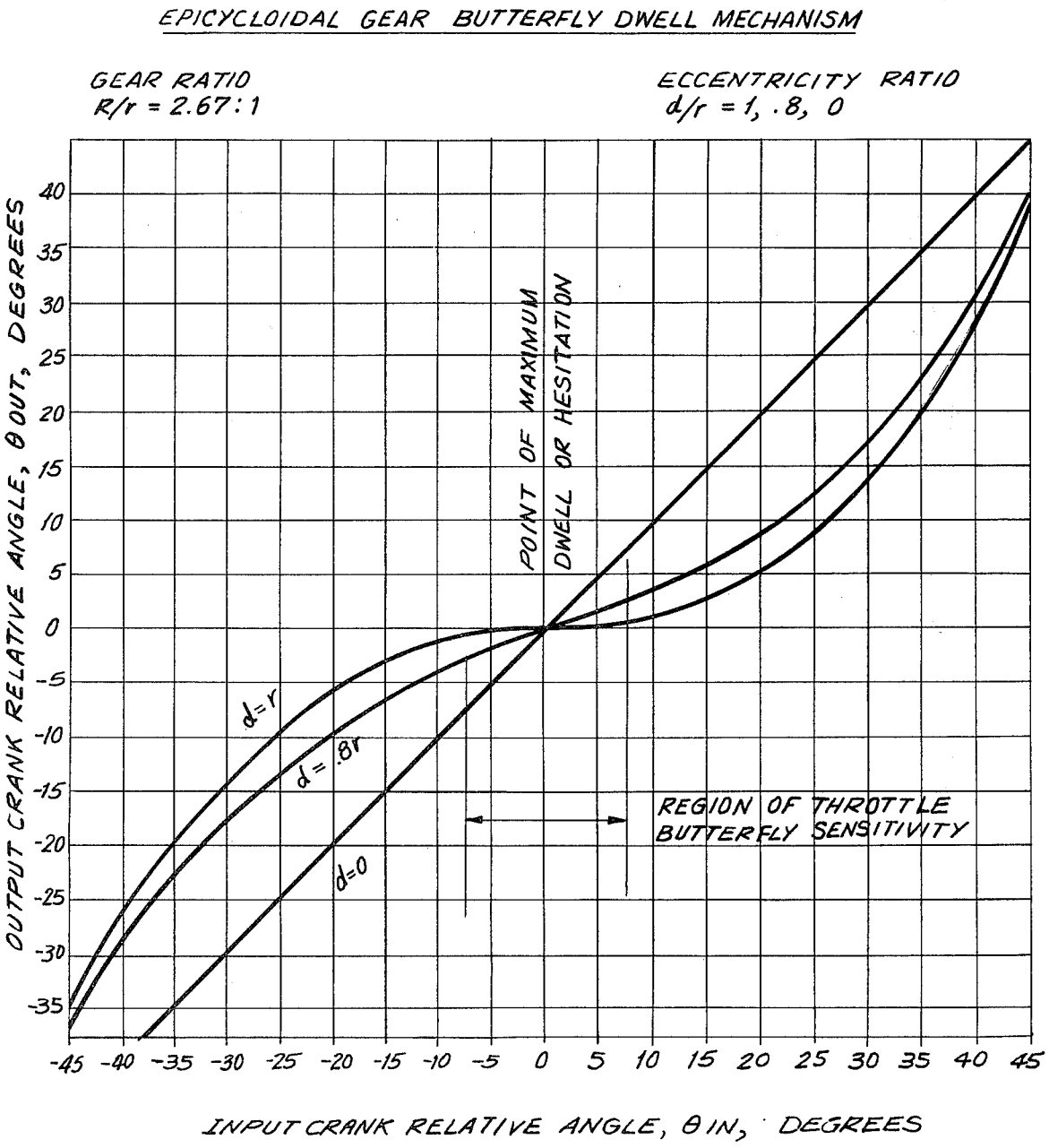
Figure 10A:
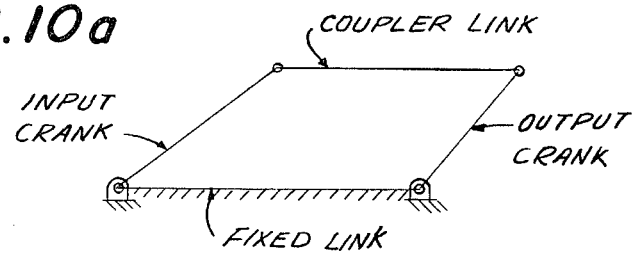
Figure 10B:
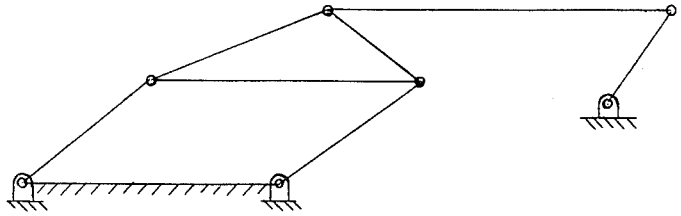
Figure 10C:
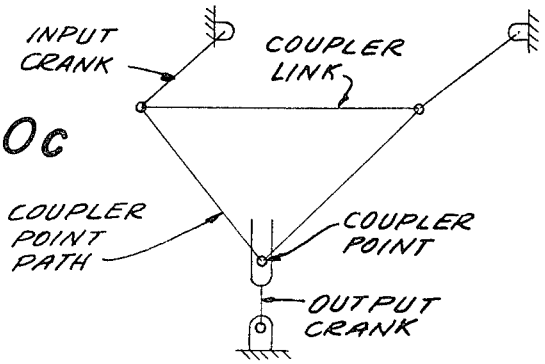
Figure 11A:
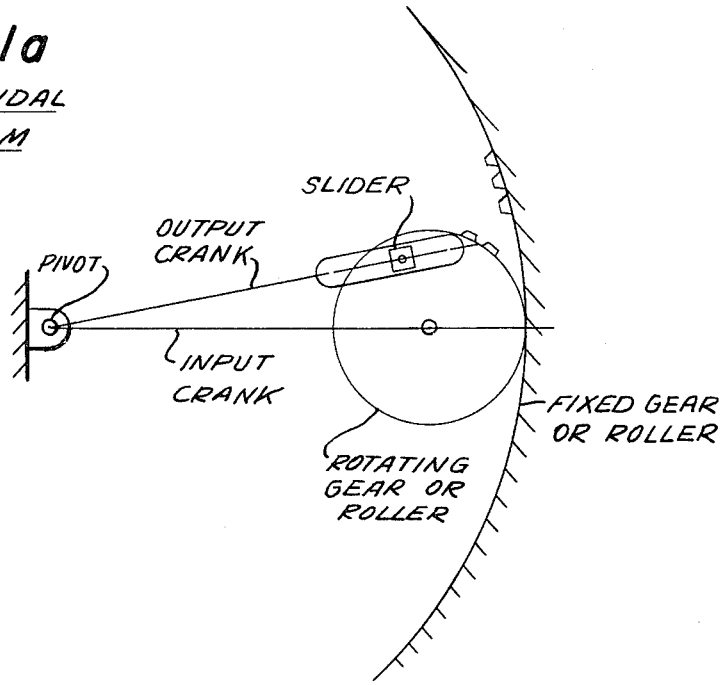
Figure 11B:
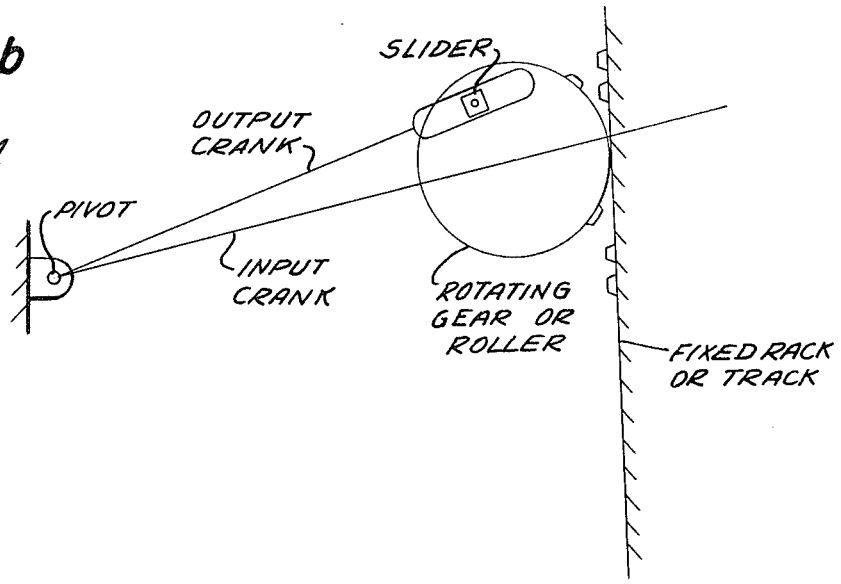

FIGS. 9(*a*) through (*c*) are curves representing the output movement advantage obtainable from the present invention and the effect of one example on the control of engine power output;

FIG. 10(*a*) is a diagram of a general 4-bar linkage mechanism;

FIG. 10(*b*) is a diagram of a general 6-bar linkage mechanism;

FIG. 10(*c*) is a diagram of a 6-bar control mechanism;

FIGS. 11(*a*) and (*b*) are line diagrams of two further examples of variable movement advantage control linkages of this invention utilizing a hypocycloidal gear train mechanism and a cycloidal gear train mechanism; and FIG. 12 is a diagrammatic representation of an exhaust wastegate valve and control actuator means therefor.

Referring to the drawings, an aircraft engine, generally designated by the numeral 10, in this case a Lycoming Nominal 350 horsepower engine, Model T10-540, a horizontally opposed, six-cylinder engine having a total displacement of 541.5 cubic inches, is shown as an example of the engine controlled by the present invention.

A conventional turbocharger, for example, an AiResearch Model T18, generally indicated by the numeral 12, is mounted on the rear of the engine. The turbocharger comprises a drive turbine section 20 and a compressor section 28.

The turbine section inlet 22 is connected to the exhaust manifold 18 from the engine, as the power source for the turbine 20. The turbine 20 is in turn mechanically connected to the compressor section 28 by a mechanical drive shaft 212. The compressor outlet 30 from the compressor housing 28 is in turn connected to an intercooler 52 by way of an intercooler duct 32. A compressed air line connects the intercooler to the air inlet control manifold 40 at the rear of the engine. The air inlet control manifold 40 connects to a butterfly valve body 42, which in turn leads into the induction sump manifold 44 directly attached to the engine block 10.

There is also provided a bleed line between the compressor and the intercooler, which operates in tandem with the butterfly inlet valve to control the air flow to the engine.

Although this invention is applicable for any high performance (preferably supercharged) internal combustion engine, one example of a system wherein this invention has special application is shown in the commonly assigned, pending application Ser. No. 257,864, filed July 10, 1981, the description of which is included herein by reference.

Figure 5:
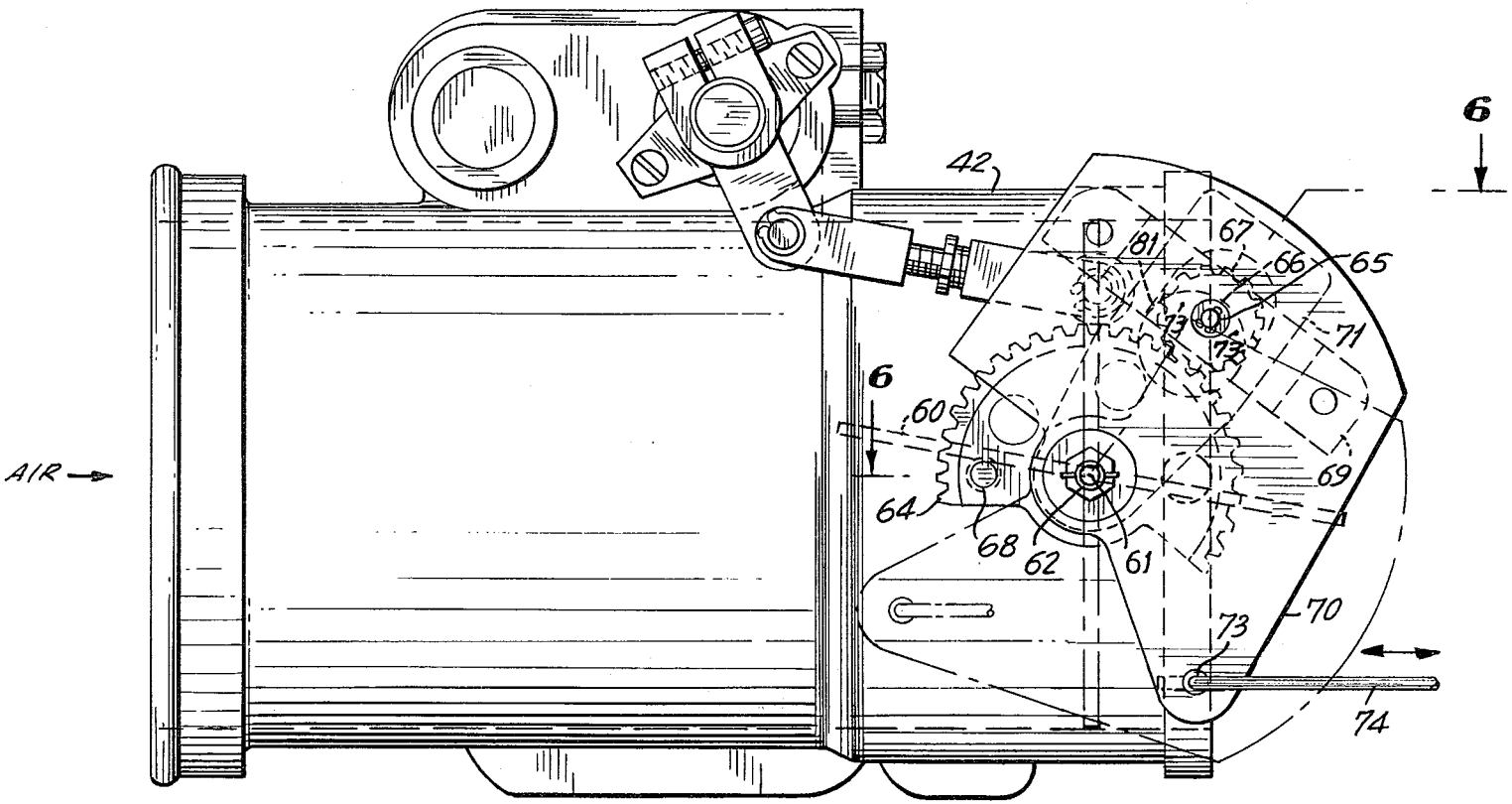
FIG. 5 is a side view of the butterfly valve body, including the mechanical control linkage of this invention.
Figure 7:
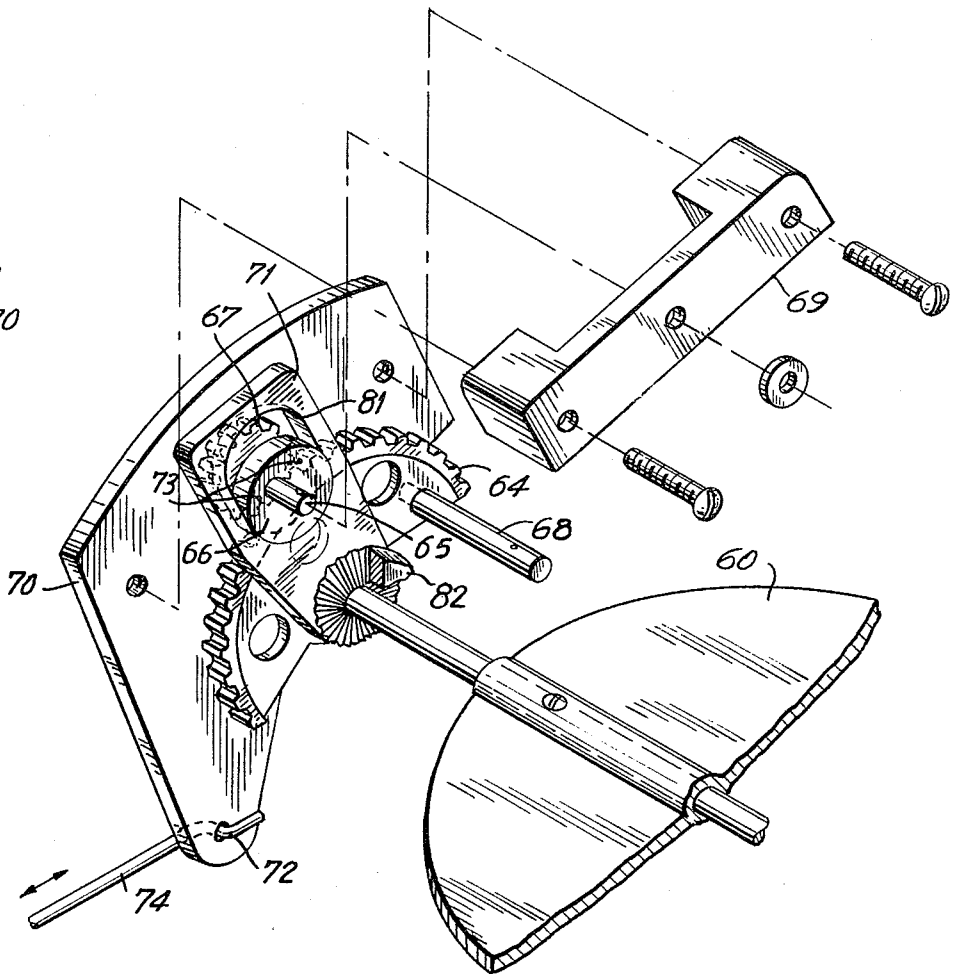
FIG. 7 is an isometric partially exploded view of the epicycloidal gear train embodiment of this invention.
Figure 6:
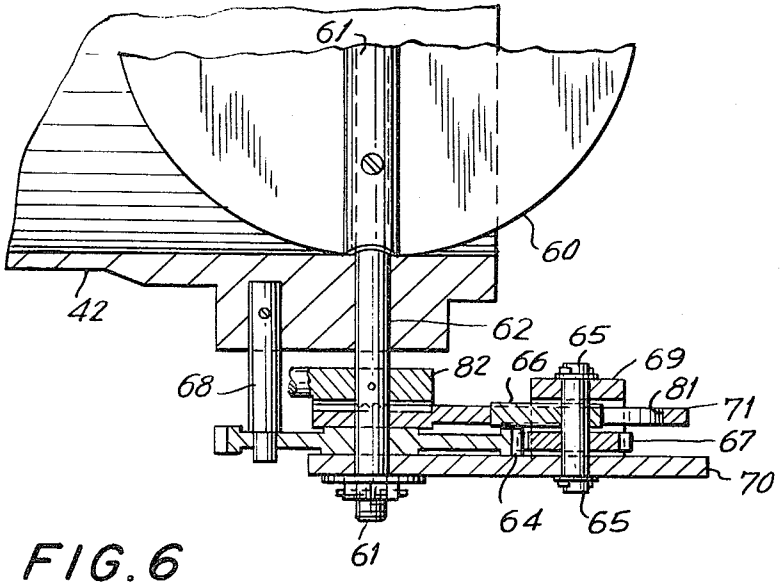
FIG. 6 is a partial sectional view of the valve body and the control linkage along lines 6—6 of FIG. 5.

The control linkage of this invention is exemplified by the details shown in FIGS. 5 through 7 of the drawings of a point-path mechanism linkage.

Located within the butterfly valve body 42 is a butterfly valve member 60 which is rotatably connected to the valve body 42 by a valve axis shaft 61, which moves within an axial bushing 62. Connected to the exterior of the valve body 42, immovably thereto, and concentric with the butterfly valve axis 61, is a fixed, toothed gear 64. The fixed gear 64 is also secured to the butterfly valve body 42 by an idle stop pin 68.

The butterfly valve body 42 is a conventionally available, Bendix Fuel Injector Servobody, available and generally used for high performance aircraft engines.

Rotatably connected to the butterfly valve member 60 so as to rotate about the valve shaft 61, is a cable arm 70. A semi-rigid, push-pull type control cable 74 is connected to the cable arm 70 at cable pin 72.

Pivotally secured to the cable arm 70, is a toothed pinion gear 67, which rotates about gear shaft 65; the gear shaft 65 in turn is secured to the cable arm 70. The teeth of the pinion gear 67 are intermeshed with the teeth of the fixed gear 64. The pinion gear shaft 65 also passes through and is rotatably connected to a circular eccentric member 66, which is pinned to the pinion gear 67 by pins 73. The center of gear shaft 65 and of the pins 73 are points along a straight line defining a chord of the circular eccentric member 66.

A butterfly drive arm 71 is operatively connected at one end about the butterfly valve shaft 61, and has a slot extending radially along the second end, the slot being defined by surfaces 81. The various members are so juxtaposed that the eccentric member 66 is on a plane with and moves within the slot 81. The lower surface of the first end of the valve arm 71, i.e., surrounding the valve shaft 61, is grooved so as to interact with and drive an idle stop arm 82, which is secured to and rotates with the valve shaft 61.

A support block 69 is secured to and moves with the cable arm 70 so as to prevent or eliminate torsion during any especially vigorous movement of the control linkage members. The support block 69 is the second anchor for, and is rotatably connected to, the pinion gear shaft 65.

In operation, pushing with the actuation arm cable 71 causes rotation of the cable arm 70 in a clockwise direction from the fully open position shown in FIG. 5. Movement of the cable arm 70 also causes movement of the pinion gear 67, which is caused to rotate as a result of its intermeshing with and circumferential movement with respect to the fixed gear 64. Axial rotation of the pinion gear 67, in turn causes cyclical rotary movement, i.e., rotation as well as longitudinal movement within the slot 81, of the eccentric 66. The combined rotation and revolution of the eccentric 66 within the slot 81, causes rotational movement of the butterfly valve arm 71, and thus of the butterfly 60.

As is conventional in such throttling valves, the butterfly valve member 60 moves from a fully closed position, wherein the valve 60 is at an angle of between 5° and 10° to the plane of the end face of the butterfly valve body 42, i.e., between 80° and 85° from the centerline of the valve body, to a fully opened position, where the valve is at an angle of approximately 10° from the centerline of the valve body. Further rotation of the butterfly valve body is not considered desirable, because of the relatively insignificant change in the open throat area upon rotating the valve member those additional 10°.

By operation of the present invention, it is possible to obtain the desired sensitive control over that region of sharp change in the mid-range of throttle operation, while at the same time increasing the incremental change in engine response for incremental movement of the manual control member during the relatively insensitive portions at the beginning and end of the valve range of movement. The variation in the output movement advantage obtained by the operation of the control linkage of the present invention is shown by the curves depicted in FIGS. 9(*a*)–(*c*).

First referring to FIG. 8, the terms that are used are explained by this representative diagram of the illustrated embodiment according to this invention. Referring to FIG. 8, the input radius, "R" is the radius of the fixed toothed gear 64; the radius "r" of the pinion gear 65, is also known as the output radius. The eccentricity value, "d", is the distance between the center of shaft 65 of the pinion gear 67 and the center of the eccentric member 66. The input angle, "$\theta_i$", represents the angular movement of the cable arm 70, as moved by the actuating cable 74, The output angle, "$\theta_o$", represents the angular movement of the valve arm 71, as moved by the eccentric 66. The base, or reference, line, where $\theta$ is equal to zero, is taken at the centerline of the throat.

The length of the actuating arm, i.e., the radial distance between the cable connector pin 72 and the valve shaft center 61, has no effect on the output movement advantage obtained. Varying this length merely enters a constant mechanical advantage factor into all of the calculations implicit in the curves shown herein, decreasing the force or increasing the stroke that must be transmitted by the cable 74 to the cable arm 70.

Referring now to the curves of FIGS. 9(*a*)–(*b*), these curves plot the change in input crank angle, "$\theta_i$", against change in output crank angle, "$\theta_o$". In FIG. 9(*a*), where the gear ratio is R/r-4:1, curves are drawn for eccentricity ratios, d/r, of 1, 0.72, and 0. As shown, for an eccentricity ratio of 1, the curve is too flat in the critical sensitive region, resulting in almost a dead spot, i.e., excessive dwell, over that range. The eccentricity ratio of 0, as always, is a straight line. The eccentricity ratio of 0.72, provides a suitable hesitation in the central, sensitive region shown between values A and B, indicating that there is sufficient hesitation to provide the pilot with adequate control over the throttle, but yet not being so slow as to require an undesirably large movement of the manual control. Similarly, as shown, the initial portion and the end portion of the output each have a slope greater than that of the straight line B=0, thus providing a desirable advanced movement during those portions of the valve range where engine response ordinarily lags.

In FIG. 9(*b*), a series of curves are shown where the gear ratio R/r is 2.67:1, and the eccentricity ratios are 0, 0.8 and 1. Here again, a desirable middle range eccentricity ratio of 0.8 provides a useful hesitation curve, but the useful range is shifted somewhat from that in FIG. 9(*a*). In both of the curves in FIGS. 9(*a*) and 9(*b*), the mid-range of butterfly sensitivity is at about an angle $\theta_i$ of 45° for the cable arm to the throat centerline, and a butterfly valve angle $\theta_o$ of approximately 37½°.

The net effect on engine response of the control linkage of this invention, where R/r=4.0 and d/r-0.72, is shown in FIG. 9(*c*). The solid line is the curve for engine response-to-angular rotation of the butterfly valve. The dashed line represents power response to the control linkage if the butterfly flow characteristics are linear with butterfly angular position. The dotted line represents the desired engine response versus input angular movement when using the control linkage of this invention. This dotted line is almost straight and represents, in effect, the sum of the other two lines.

It can be seen that the maximum hesitation effect of the control linkage according to this invention can be varied in location and as to slope, i.e., extent of hesitation or movement advantage, by varying the gear ratio and the eccentricity ratio. Thus, the control linkage can be tailored to the particular throttling valve as used in any particular engine and set of conditions.

In the embodiment shown in FIGS. 5, 6 and 7, the butterfly valve is at the full open position when it is 10° from the throat centerline. The radius of the eccentric is 10° clockwise away from the radius of the fixed gear 64 that also passes through the center of the pinion gear 67. The length of the actuating arm 70 is in this case approximately 1.55 ins., d=0.18 in., r=0.15 in., and the radius of the fixed gear 64, R, is about 0.44 in., the maximum movement of the eccentric tric along the slot 81 is about 0.38 in.

In general, this invention contemplates the use of any "4-bar" mechanical linkage that provides hesitation, or movement advantage, wherein the greatest hesitation or movement advantage is in a central or middle portion of the total angular movement of the device. It is generally preferred that the area of greatest hesitation be at a mid-range of the total movement of the butterfly valve, generally closer to the idle end of the movement than to the fully open end, for example, centered upon the open angle $\theta$=55°. As shown by the graphs, the total overall movement of the input and output cranks is preferably the same.

In addition to the epicycloid gear train of this invention, shown and described hereinabove (FIGS. 5–8), other types of such hesitation mechanisms can be used. For example, a hypocycloid mechanism, where the fixed gear is concave, instead of convex, i.e., where the teeth extend inwardly from an interior circumference, can be used. Similarly, a cycloidal gear train, where a straight line rack is used in place of the curved fixed gear, can be useful. Similarly, the eccentric slides linkage can be replaced by an elliptic gear train.

The various types of linkages that are useful herein have in common the generation of a curve having a "cusp", or change in slope, by a selected point on one link. This point provides the input motion to the subsequent series of links, or gears or rollers, to provide the desired output motion. It is also preferred that the output move in the same direction as the input; this requires that the "degree" of hesitation must be an even number. Most particularly, a "second degree hesitation" system is provided where only velocity and acceleration vary.

Figure 1:
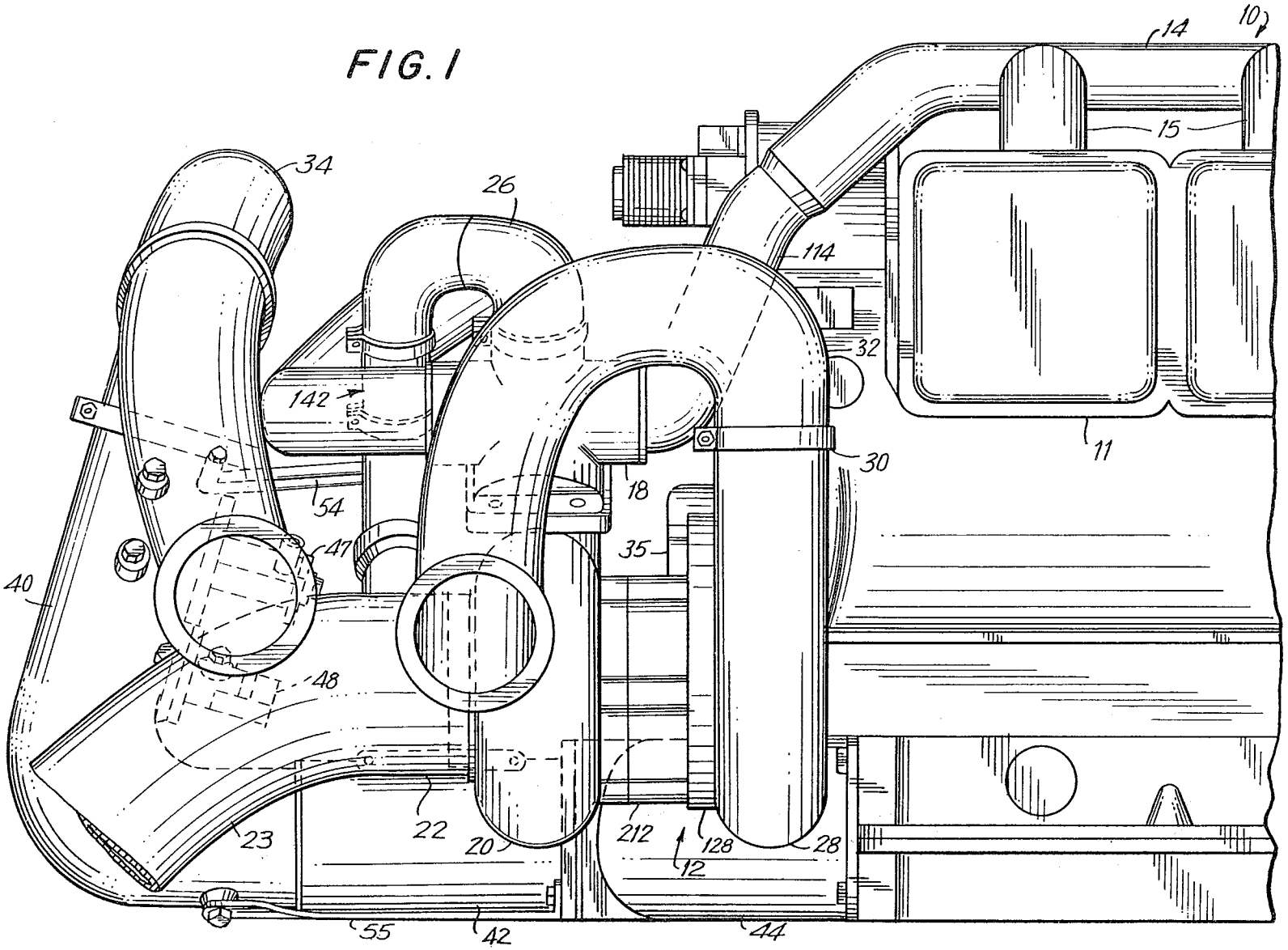
FIG. 1 is a partial side view of the rear of an aircraft engine including the inlet valve operated by the linkage of this invention.
Figure 2:
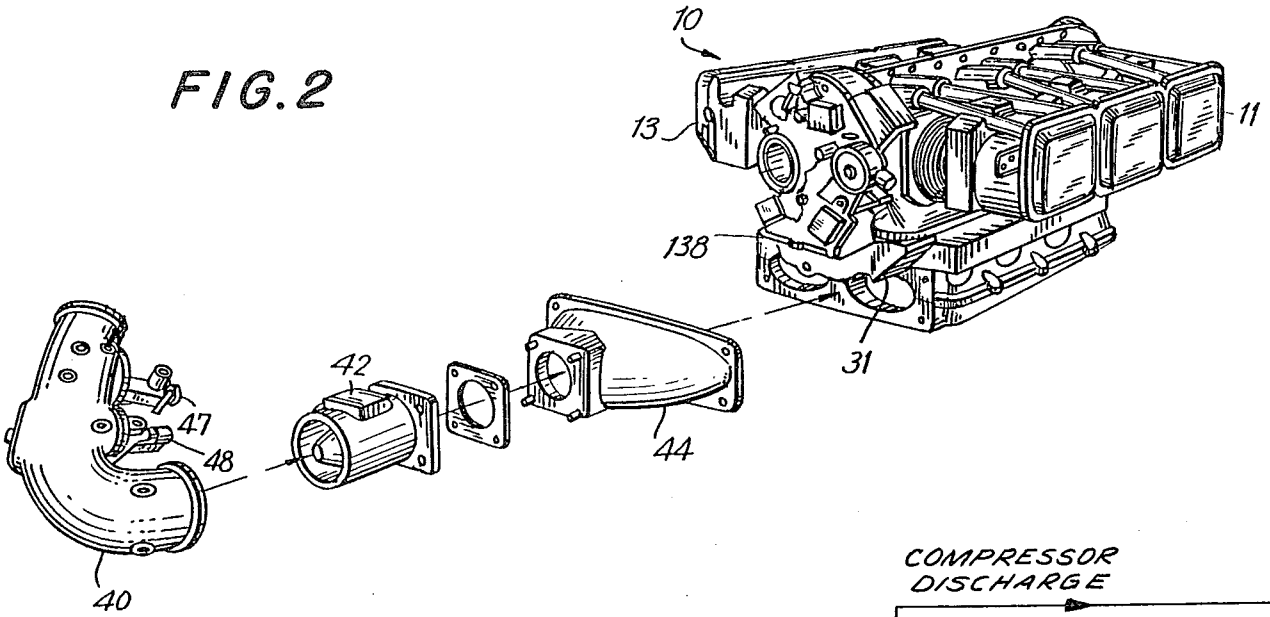
FIG. 2 is an exploded view of some of the relevant portions of the aircraft engine including the present invention.
Figure 3:
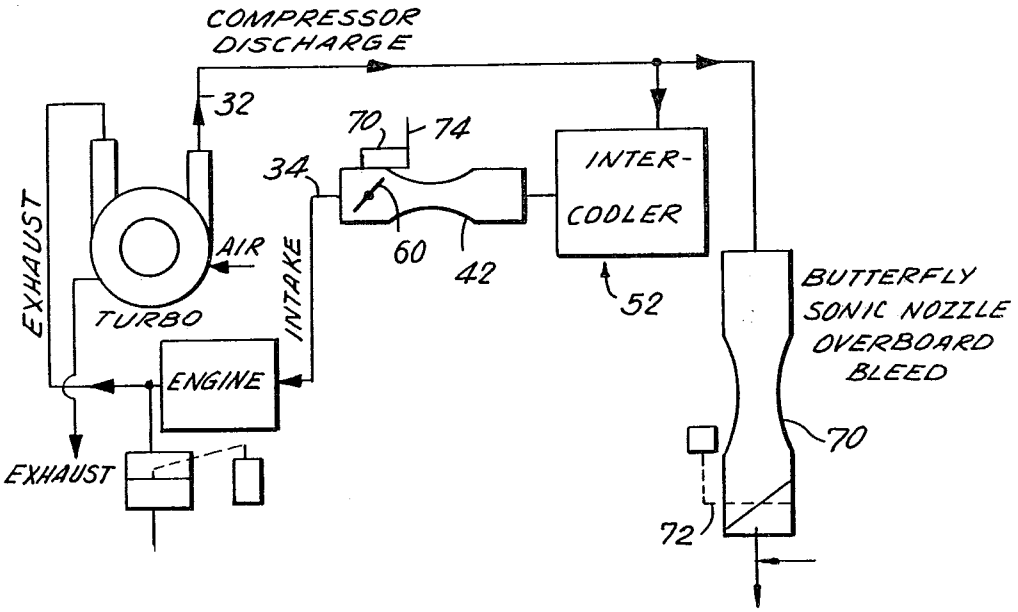
FIG. 3 is a diagrammatic representation of the air flow system including the control linkage of this invention, for an aircraft.
Figure 4:
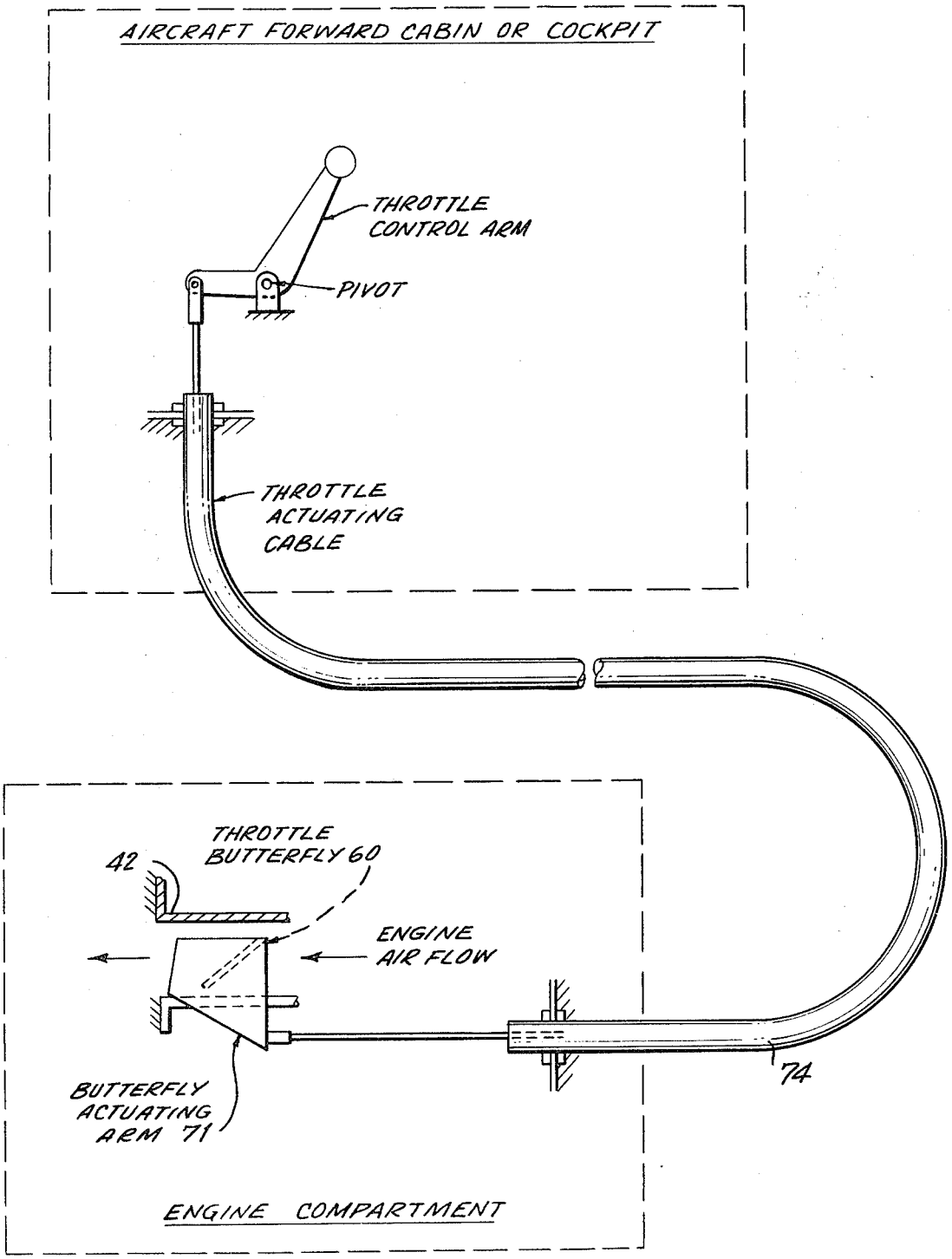
FIG. 4 is a schematic view of the system of controls between the pilot operator and the mechanical linkage of this invention in an aircraft.

One context in which the valve control linkage of this invention can be most effectively used, as stated above, is in a turbocharged aircraft engine. In such a device, the inlet air compressor is operated by the exhaust gases from the engine, that drive the turbine 20, as shown in FIG. 2. In order to operate the turbocharger at optimum efficiency, it is preferred that the air flow be maintained over a relatively narrow range, regardless of the needs of the engine. To accomplish this, a portion of the compressed air from the compressor can be bled off to the atmosphere through a sonic nozzle, or overboard bleed valve 70, as shown in FIG. 3. Such a bleed valve is preferably controlled in tandem with the butterfly inlet valve 42, such that the operation of the bleed valve 70 is the reverse of that of the inlet valve 42, i.e., an opening of the air inlet valve requires a further closing of the bleed valve and vice versa. Thus, a single cable control member in the pilot's compartment can be used for controlling the two devices, with a separate 4-bar type linkage between the cable and bleed valve.

The bleed valve and the turbocharger are devices that are well known to the art, and various designs and control means are conventional in the art. A most preferred system is shown in the co-pending commonly assigned application Ser. No. 281,944.

When using the control linkage of this invention for operating a butterfly valve (or throttle) in the carburetor, or other fuel control device of an aircraft engine, the range of greatest precision of control, can be changed to conform to the primary operating characteristics of the aircraft. For example, if the aircraft were to be used principally at lower altitudes, e.g., below 10,000 ft., the range of greatest hesitation can be adjusted to center on a higher value of $\theta$, greater than 45°, i.e., closer to the closed position. If the aircraft is to be operated at higher altitudes, i.e., above 20,000 ft., the range of greatest hesitation can be moved to a value of $\theta$ below 45°, i.e., closer to the full open position. In the example illustrated by FIG. 9(*c*), the center of the hesitation region was at a value of $\theta_o$ in the range of 45°–50°.

It is also quite simple to provide an external control device to adjust the point of maximum dwell according to altitude, thus providing optimum throttle response for any operational altitude. The center of the hesitation region can be varied for example by adjusting the angular position of the fixed gear 64 (together with the pinion gear 67 and eccentric member 66), relative to the valve body 42, the butterfly member 60 and the output crank 71. When making this adjustment, the eccentric member 66 is moved longitudinally along the slot 81 within rotating the valve arm 71.

The central linkage of this invention may also be used to control an exhaust gas wastegate valve 142 of a turbocharged engine. FIG. 12 illustrates a typical butterfly exhaust by-pass (wastegate) valve 242. The butterfly member 160 is typically controlled by a linear actuator such as a hydraulic piston cylinder, which in turn responds to engine oil pressure, via sensor line 262: an increase in engine output, increases oil pressure and closes the wastegate butterfly 160. Such manifold pressure wastegate controllers are conventional, and have been manufactured, e.g., by AiResearch, Inc. and Roto Master, Inc. The control linkage 270 of this invention, of the type shown in FIGS. 5–7, is inserted between the piston rod 280 of the actuator and the butterfly member 160 to improve exhaust flow response and hence turbocharger response to engine requirements. This also allows a larger wastegate to be utilized to prevent engine overboosting while still providing adequate control of exhaust gas flow at the lower by-pass flow rates. Alternatively, a manually operated wastegate can be used, linked together with the control for the air intake throttle.

The patentable embodiments of this invention which are claimed are:

1. An improved engine throttle control for controlling the power output of an engine, by controlling the flow of combustion air to the engine, the throttle control comprising a butterfly-type throttling valve, a rotating butterfly-type valve member within the valve throat, the valve member rotating between a first end position closing the valve throat and a second end position fully opening the valve throat; a rotating actuating member for operating the valve member; a mechanical control means for causing rotation of the actuating member; and a variable rate mechanical control linkage between the actuating member and the valve member, the control linkage providing a variable output movement advantage between the actuating member and the rotating valve member, the output movement advantage being less than one during those portions of the range of rotation of the valve relatively adjacent the two end positions of the valve, and the output advantage during a mid-range portion of the rotation of the valve member being greater than one, thereby rendering more nearly linear the relationship between the rotation of the actuating member and the change in flow area in the throat.

2. The engine throttle control of claim 1, wherein the control linkage comprises a 4-bar linkage.

3. The engine throttle control of claim 2, wherein the control linkage comprises a 6-bar linkage.

4. The engine throttle control of claim 3, wherein the control linkage comprises a point path mechanism.

5. The engine throttle control of claim 2, wherein the control linkage comprises a cyclic gear train.

6. The engine throttle control of claim 5, wherein the control linkage comprises an epicyclic gear train.

7. An engine throttle control having improved response over the mid-operating range, the throttle control comprising a butterfly-type throttling valve including a valve throat therethrough, a rotating valve member situated within the throat and capable of rotating about its diameter between a first end position closing the valve throat and a second end position fully opening the valve throat, and a rotating actuating member operatively connected to the valve member; manual control means for causing rotation of the actuating member; and mechanical control linkage means between the actuating member and the valve member, the control linkage means comprising a fixed member secured to and relatively immovable with respect to the valve throat, the fixed member having a toothed periphery; a rotating gear member rotatably secured to the actuating arm, the gear member having teeth and being so juxtaposed with respect to the fixed member that the teeth intermesh with the teeth of the fixed member; an eccentric member, fixed to the rotating gear member and capable of rotating therewith, the center of the eccentric member being radially removed from the center of the rotating gear member; and a valve crank, directly connected to the butterfly valve member and rotatable therewith, the valve crank defining a race for the eccentric, wherein the eccentric can rotate and slide radially therealong, the eccentric driving the valve crank in rotary motion; the control linkage means providing a cyclically variable output motion advantage between the actuating member and the valve crank, the advantage being less than one during those portions of the rotation of the valve member adjacent the two valve end positions, and the advantage being greater than one during a mid-range of the rotation of the valve, thereby rendering more nearly linear the relationship between the rotation of the actuating member and the change in flow area in the valve throat.

8. The throttle control of claim 7, wherein the periphery of the fixed member is in the shape of an arc of a circle.

9. The throttle control of claim 8, wherein the periphery of the fixed member is convex.

10. The throttle control of claim 7, wherein the valve crank race is a slot within which fits the eccentric member, the slot extending radially along the valve crank.

11. The throttle control of claim 8, wherein the valve member rotates a total of less than 85° between its fully closed first end of rotation and its fully opened second end of rotation, and wherein the mid-range region, is centered at an angular opening in the range of between about 35° and 50° from the longitudinal axis of the valve throat.

12. The throttle control of claim 9, having a gear ratio R/r in the range of from about 2.5 to about 5, wherein R is the radius of the fixed gear and r is the radius of the rotating gear member, and an eccentricity ratio, d/r, in the range of from about 0.6 to about 0.9, wherein d is the distance between the center of the rotating gear member and the center of the eccentric member.

13. In a powered aircraft comprising an internal combustion engine; a turbocharger having a compressed air outlet and an exhaust gas inlet; an air inlet to the engine in fluid flow connection with the compressed air outlet; an engine exhaust outlet in fluid flow connection with the exhaust gas inlet; first butterfly-type throttling valve installed between the air inlet and the compressed air outlet for controlling air flow to the engine; a second butterfly-type throttling valve installed between the exhaust outlet and the atmosphere, in parallel to the flow to the exhaust gas inlet to vary exhaust gas flow thereto; each of the throttling valves including a valve throat therethrough, a rotating valve member situated within the throat and capable of rotating about its diameter between a first end position closing the valve throat and a second end position fully opening the valve throat, and a rotating actuating member operatively connected to the valve member; and control means for causing rotation of each actuating member; the improvement comprising a variable rate mechanical control linkage between each rotating valve member and each actuating member, the control linkage providing a variable output movement advantage between the actuating member and the rotating valve member, the output movement advantage being less than one during those portions of the range of rotation of the valve relatively adjacent the two end positions of the valve, and the output advantage during a mid-range portion of the rotation of the valve member being greater than one, thereby rendering more nearly linear the relationship between the rotation of the actuating member and the change in flow area in the throat.

14. The powered aircraft of claim 13, wherein a single pilot operated control means is operatively connected to both actuating members, such that both the engine air flow and exhaust gas by-pass are operated in parallel and substantially simultaneously.

15. The powered aircraft of claim 13, further comprising a third butterfly-type throttling valve installed in fluid flor connection to the compressed air outlet in parallel to the first throttle valve and a pressurized air system, the third throttle valve being installed beyween the compressed air outlet and the system.

16. The throttle control of claim 7, wherein the periphery of each of the fixed member and the rotating gear member is a non-circular curved line.

* * * * *

UNITED STATES PATENT AND TRADEMARK OFFICE

CERTIFICATE OF CORRECTION

PATENT NO. : 4,424,781

DATED : January 10, 1984

INVENTOR(S) : Stephen R. Speer, et al

It is certified that error appears in the above–identified patent and that said Letters Patent are hereby corrected as shown below:

Claim 15, line 3, "flor" should be --flow--.

Claim 15, line 5, "beyween" should be - between--.

Signed and Sealed this

*Fifth* Day of *June 1984*

[SEAL]

*Attest:*

GERALD J. MOSSINGHOFF

*Attesting Officer*

*Commissioner of Patents and Trademarks*